US008664416B2

(12) United States Patent
Bournay et al.

(10) Patent No.: US 8,664,416 B2
(45) Date of Patent: Mar. 4, 2014

(54) PROCESS FOR THE PRODUCTION OF ALKYL ESTERS FROM ANIMAL OR VEGETABLE OIL AND AN ALIPHATIC MONO-ALCOHOL WITH THERMAL INTEGRATION

(75) Inventors: Laurent Bournay, Chaussan (FR); Vincent Coupard, Villeurbanne (FR); Pierre-Yves Martin, Rueil Malmaison (FR); Yves Scharff, Montesson (FR); Yann Lepine, Rueil-Malmaison (FR)

(73) Assignee: IFP Energies nouvelles, Rueil-Malmaison Cedex (FR)

( * ) Notice: Subject to any disclaimer, the term of this patent is extended or adjusted under 35 U.S.C. 154(b) by 304 days.

(21) Appl. No.: 13/277,421

(22) Filed: Oct. 20, 2011

(65) Prior Publication Data

US 2012/0101288 A1 Apr. 26, 2012

(30) Foreign Application Priority Data

Oct. 21, 2010 (FR) ..... 10 04122

(51) Int. Cl.
*C11C 3/00* (2006.01)

(52) U.S. Cl.
USPC ..... 554/169

(58) Field of Classification Search
None
See application file for complete search history.

(56) References Cited

U.S. PATENT DOCUMENTS

| | | | | |
|---|---|---|---|---|
| 2,727,049 | A * | 12/1955 | Braconier et al. | 554/167 |
| 6,878,837 | B2 | 4/2005 | Bournay et al. | |
| 7,138,536 | B2 * | 11/2006 | Bournay et al. | 554/167 |
| 7,951,967 | B2 | 5/2011 | Chun et al. | |
| 2004/0034244 | A1 | 2/2004 | Bournay et al. | |
| 2006/0014974 | A1 | 1/2006 | Bournay et al. | |
| 2008/0269513 | A1 | 10/2008 | Sarangan et al. | |
| 2009/0277077 | A1 | 11/2009 | Gleason et al. | |

FOREIGN PATENT DOCUMENTS

| | | | |
|---|---|---|---|
| DE | 10 2007 040 782 | A1 | 3/2009 |
| EP | 1 352 893 | A1 | 10/2003 |
| WO | 2006/036836 | A1 | 4/2006 |
| WO | 2007/126166 | A1 | 11/2007 |
| WO | 2008/120223 | A2 | 10/2008 |

OTHER PUBLICATIONS

Search Report, dated Jun. 14, 2011, issued in corresponding FR 10/04.122.

* cited by examiner

*Primary Examiner* — Yate K Cutliff
(74) *Attorney, Agent, or Firm* — Millen, White, Zelano & Branigan, P.C.

(57) ABSTRACT

The present invention describes a process for the production of alkyl esters of fatty acids and glycerine employing, in a reaction section, at least one transesterification reaction between an animal or vegetable oil and an aliphatic mono-alcohol, and using a heterogeneous solid catalyst, in which the energy balance is improved by thermal integration of the energy released during the mono-alcohol condensation step.

14 Claims, 2 Drawing Sheets

PROCESS FOR THE PRODUCTION OF ALKYL ESTERS FROM ANIMAL OR VEGETABLE OIL AND AN ALIPHATIC MONO-ALCOHOL WITH THERMAL INTEGRATION

FIELD OF THE INVENTION

The invention relates to a process for the production of alkyl esters from vegetable or animal oils and an aliphatic mono-alcohol.

STUDY OF THE PRIOR ART

With a view to using them as a biofuel, alkyl esters of vegetable oils are produced from vegetable oils derived, for example, from rapeseed, sunflower, soya or even from palm. Vegetable oils, which are essentially constituted by triglycerides, are poorly adapted to being supplied directly to the modern diesel engines of particular vehicles; they can, for example, be transformed by a transesterification reaction with an aliphatic mono-alcohol, for example methanol or ethanol, introduced in excess to produce vegetable oil methyl esters (VOME) and glycerine.

The Esterfip-H™ process, described in particular in patent application EP-A1-1 352 893, is a process employing a set of transesterification reactions between an animal or vegetable oil and methanol, using a heterogeneous catalyst. That process includes certain energy-consuming steps. A heterogeneous catalyst is employed at high temperatures, in the range 170° C. to 210° C., at high pressures in the range 3 to 8 MPa in order to remain in the liquid phase, and requires an excess of methanol (methanol/oil weight ratio in the range 0.5 to 2) in order to displace the thermodynamic equilibrium and push the conversion of the oil towards ester production. Because of that displacement of the thermodynamic equilibrium, that process is carried out in two reaction steps with intermediate withdrawal of a portion of the glycerine which is co-produced. That separation operation is carried out by decanting, at a temperature in the range 50° C. to 70° C., in the presence of a small quantity of methanol. This latter acts as a co-solvent between the ester and glycerine phases. This involves a step for separation of the methanol contained in the effluent from the first transesterification reactor. In addition, in order to satisfy the specification of a maximum of 2000 ppm of methanol in the final ester set by European biofuel standard EN 14 214, it is also necessary to carry out separation of the excess alcohol present at the outlet from the second transesterification reactor.

That methanol separation is obtained by evaporation during expansion of the hot effluents leaving the first and second reactors. In order to obtain a stable pressure in the reactors despite the fluctuations inherent to the process, the cross section of flow has to be variable and regulated by a pressure regulating valve. That expansion is accompanied by evaporation, principally of methanol. The boiling point of methanol is very low compared with those of the other substances contained in the effluent leaving the reactor. This is illustrated in the table below, which shows the molar masses, densities and boiling points under normal conditions of the principal compounds under consideration:

| Component | Molar Mass kg/kmol | Density at 15° C. kg/m³ | Normal boiling point ° C. |
|---|---|---|---|
| Water | 18.0 | 998.6 | 100 |
| Methanol | 32.0 | 795.6 | 65 |
| Glycerine | 92.1 | 1265.1 | 290 |
| Ester | 296.5 | 876.9 | 344 |
| Mono-glycerides | 356.6 | 941.1 | 358 |
| di-glycerides | 621.1 | 928.1 | 367 |
| Oil | 885.5 | 915.6 | 375 |
| Oleic acid | 282.5 | 892.1 | 370 |

During this step, a portion of the sensible heat from the effluent is converted into the latent heat necessary for the change of state of the methanol (passing from the liquid phase to the vapour phase). This results in a reduction in the temperature of the effluent. The lower the pressure reached during the expansion and the larger the quantity of methanol which is evaporated, the lower will be the temperature reached after expansion.

Thus, for a given composition and temperature of the effluent leaving the reactor, at a pressure such that it is entirely in the liquid form and for a given pressure after expansion, the compositions of the liquid and vapour fractions as well as the temperature of the system are fixed and may be predicted by means of calculations (thermodynamic model and a method for determining the composition of the phases at liquid/vapour equilibrium) which are well known to the skilled person.

At the end of the expansion step, the effluent from the reactor is constituted by a vapour fraction and a liquid fraction which are separated in what the skilled person terms a flash drum, which is a vessel in which liquid droplets are separated from the ascending vapour flow under gravity.

In the flowchart of the current process as described in patent application EP-A1-1 352 893, the effluents from the first and second reactors are expanded at a very low pressure, respectively 0.25 and 0.15 MPa absolute, in order to maximize the quantity of methanol evaporated. In order to be recycled to the reactors operating in liquid phase mode, this methanol vapour has to be condensed. However, it is well known to the skilled person that the temperature at which a substance changes state depends on the pressure at which that operation is carried out. The lower the pressure, the lower the temperature has to be to carry out the condensation. Thus at 0.2 MPa absolute, the condensation temperature of pure methanol is 83° C. In contrast to evaporation, condensation will allow a quantity of energy corresponding to the enthalpy of condensation of the methanol from the vapour state to the liquid state to be exchanged. This energy is transferred to a fluid termed a cold fluid, generally cooling water, in a heat exchanger.

During that step, the latent heat necessary for the methanol to change state is converted into the sensible heat of the cold fluid. This results in an increase in the temperature of the cooling water which in turn is cooled in a dedicated system. The energy transmitted to that fluid is thus considered to be lost as regards the process.

The series of steps of the reactions with a large excess of methanol at high temperatures and steps for evaporation of methanol in excess which then has to be condensed for recycling via a recycle knockout drum consumes a fair amount of energy which is thus detrimental to the profitability of the process.

It would be interesting to modify the flowchart of the current process in order to limit the energy losses and to improve the overall energy balance, in particular by using this quantity of available heat linked to the change of state of the methanol, to re-heat a stream of the process while improving the water circulation flowchart employed in the process.

SUMMARY OF THE INVENTION

The present invention proposes a process for the production of methyl esters from vegetable or animal oils and methanol, in which the steps for expansion of the effluent from the reactor or reactors is carried out in a staged manner in at least two successive phases, at least two different pressures.

DETAILED DESCRIPTION OF THE INVENTION

Figure 1:
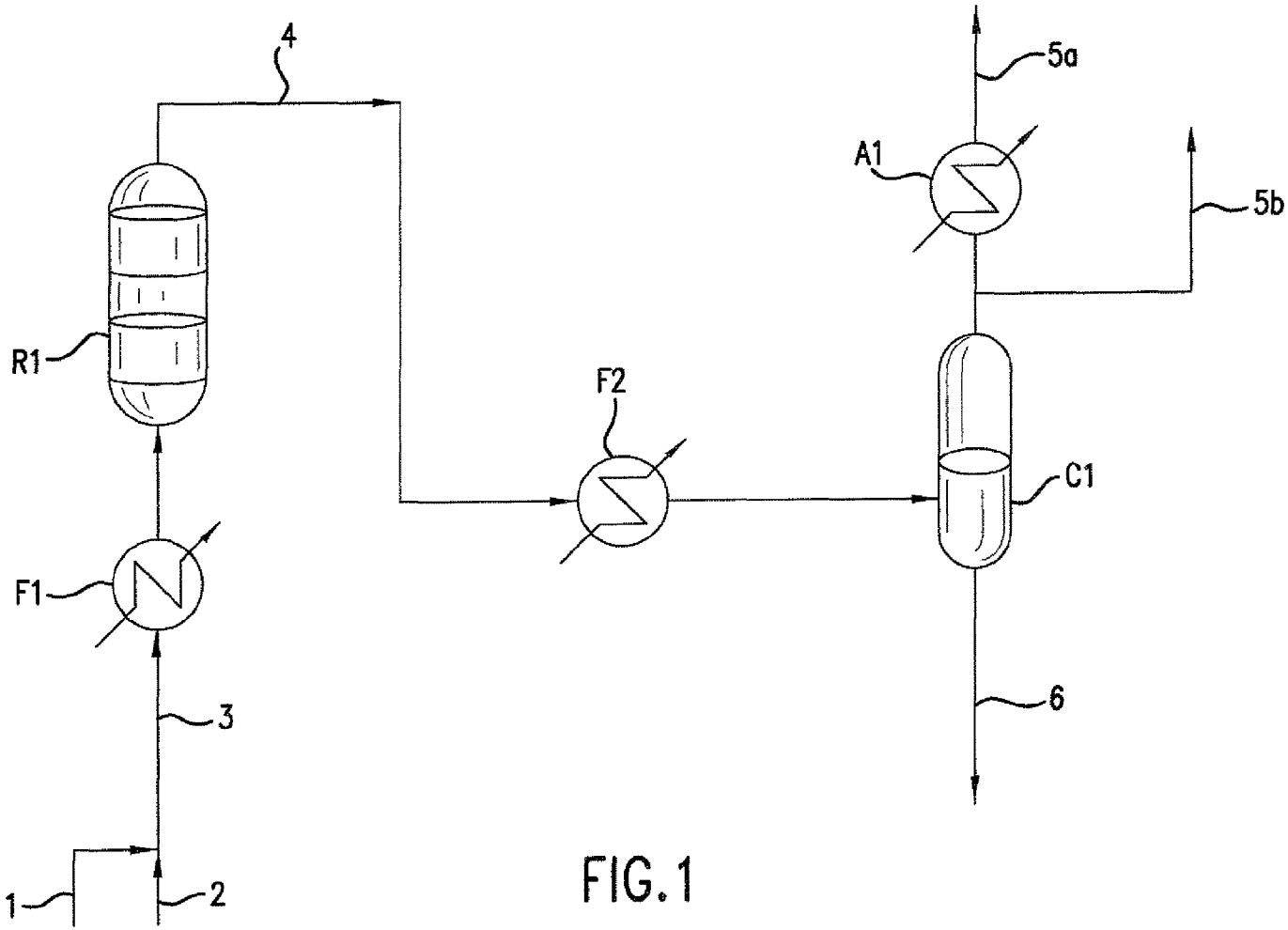
FIG. 1 is a diagrammatic representation of a portion of the Esterfip-H™ process as described in EP-A1-1 352 893.

The process of the present invention is a process for the production of methyl esters of fatty acids and high purity glycerine, employing at least one transesterification reaction between a vegetable or animal oil and methanol, in the presence of a solid heterogeneous catalyst, comprising in succession:

- at least one transesterification step during which the vegetable or animal oil is mixed with an excess of methanol in a reactor containing a fixed bed of catalyst;
- at least one step for expansion of the effluent from the reactor, followed by a step for separation, at the end of which a phase which is rich in methanol and a phase which is depleted in methanol are obtained;
- at least one step for concentration of the methanol contained in the rich phase;
- at least one step for decanting the methanol-depleted phase to separate the glycerine from the upper phase which is rich in methyl esters;

said process being characterized in that said step for expansion and separation of methanol is staged and is carried out in at least two phases:

a) a first phase for expansion carried out at a pressure of at least 0.5 MPa, in order to obtain a first fraction of methanol vapour and a liquid fraction containing non-evaporated methanol, methyl esters, glycerol and partially converted triglycerides, said first phase for expansion and separation being followed by a step for condensation of said methanol vapour fraction into a fraction of methanol which is liquid at a temperature of at least 111° C., releasing a quantity of energy Q, the liquid methanol fraction obtained being sent directly to a recycle knockout drum, at least a portion of said quantity of energy Q being used to heat at least one of the process streams;

b) a second phase for expansion, at a pressure which is lower than that of step a) of the liquid fraction containing non-evaporated methanol, methyl esters, glycerol and partially converted triglycerides, in order to obtain a second fraction of methanol vapour, at least a portion of said second fraction being sent to the recycle knockout drum after having undergone a condensation step, the other portion of said second fraction being sent to the methanol concentration step.

In accordance with one implementation, said second fraction obtained in step b) and sent to the methanol concentration step may undergo a condensation step at the end of which a liquid fraction comprising a mixture of methanol and water is obtained, before being sent to the methanol concentration step.

The two condensation steps carried out in step b), respectively of the fraction to be sent to the recycle knockout drum and of the fraction to be sent to the methanol concentration step, may be carried out together or separately.

When the condensation steps carried out on the two portions of the second fraction are carried out together, the whole of the methanol vapour fraction obtained after the second expansion phase of step b) undergoes a condensation step before being separated into two fractions, one being sent to the recycle knockout drum and the other to the methanol concentration step.

Thus, by carrying out staged expansion at a first pressure of more than 0.5 MPa, the condensation temperature is higher than that which would be obtained if the expansion were to be carried out at a single, lower pressure, as described in the prior art process.

Thus, it becomes possible to use the quantity of energy corresponding to the enthalpy of condensation from the vapour state to the liquid state to advantageously heat a stream moving in the process. The total quantity of energy necessary for the process to function is thus substantially reduced.

The process of the invention can also advantageously be used to adapt the degree of expansion in order to obtain methanol which is sufficiently pure to contain as little water as possible.

Water inhibits the catalyst and its presence in the reaction medium must be limited in order to prevent the activity of the catalyst from falling, and thus the conversion of the oil being insufficient. Further, the presence of water promotes the formation of fatty acids, and thus of reactants that are likely to react to form soaps.

Water is introduced into the process via the feeds introduced (oil, methanol) and is also produced during secondary reactions. In the absence of a dedicated system for de-concentration of this water both introduced into the process and produced in situ, a phenomenon of accumulation via the methanol recycle loop may result in water contents which are detrimental to the activity of the transesterification catalyst.

Judicious fixing of the conditions during the first phase for expansion of the effluent from the transesterification reactor or reactors means that it becomes possible to obtain methanol with a water content which is lower than that obtained using the prior art process.

In fact, by carrying out staged expansion steps at different pressures, two streams are obtained with different water contents. Thus, a "dryer" loop can be obtained by evaporation. As a result, the methanol obtained after passing through a first flash drum functioning at a pressure of at least 0.5 MPa may be sent directly to the recycle knockout drum, without passing through a concentration step given that the quantity of water in this loop is more limited. In this manner, only a portion of the methanol, that containing more water, has to be sent to the concentration step.

The methanol concentration step is advantageously carried out in a distillation column that can separate methanol and water. The methanol leaving the column head is concentrated and thus, after condensation, can be sent to the recycle knockout drum. Thus, because of the process of the present invention, it becomes possible to reduce the energy consumption of the distillation column allowing the water to be separated: the quantity of methanol introduced into this column is smaller than that of the prior art process. For identical quantities of water moving in the process, the quantity of energy consumed for the methanol concentration step is lower.

Advantageously, after the first expansion phase, the methanol stream obtained is more concentrated as it is depleted in water, meaning that a quantity of heat energy compatible with the requirements of the process can be recovered.

The first fraction of methanol vapour obtained after the first expansion phase advantageously contains less than 1000 ppm of water.

The quantity of energy Q corresponding to the enthalpy of condensation from the vapour state to the liquid state following the first phase for expansion of the effluent from the transesterification reactor is advantageously used to pre-heat the stream of oil, for example, prior to mixing with the methanol before entering the first transesterification reactor.

In another implementation, the quantity of energy Q is advantageously used to pre-heat the recycled methanol stream before it is mixed with the oil pre-treated upstream of the transesterification reactor inlet.

In accordance with another implementation, the quantity of energy Q is advantageously used to directly pre-heat the stream entering the transesterification reactor, which is thus constituted by a mixture of oil and alcohol.

The process of the invention may advantageously comprise two transesterification reaction steps. The phase which is rich in methyl esters, also known as the ester phase, is mixed with methanol before being sent to a second transesterification reactor. This phase also contains partially converted glycerides and is obtained at the end of the first reaction step after expansion, separation of methanol vapour, cooling and decanting. In this case, the steps of expansion, concentration of methanol and decanting to separate the co-produced glycerine are repeated at the outlet from each reactor.

The step for expansion of the effluent at the outlet from the second reactor is also carried out in a staged manner, as described above. Thus, at the outlet from the first expansion phase carried out at a pressure of at least 0.5 MPa, a stream of methanol is obtained which contains less than 1000 ppm of water which is sent directly to the recycle knockout drum. At the end of the second expansion phase, the stream constituted by the methanol/water mixture is also sent to the distillation column.

In a process comprising two reaction steps in succession, the pressures at which the expansion phases are carried out respectively at the outlet of the first and the second reactor may be different.

In another implementation, in a process with two reaction steps, the quantity of energy derived from the condensation of methanol at the outlet from the first and/or the second reactor may be used irrespectively to pre-heat one of the effluents entering the first and/or the second reactor.

Thus, this quantity of energy may be used, as described above, to pre-heat the stream of oil, the stream of methanol or the mixture of oil and ethanol entering the first transesterification reactor.

When the process employs two transesterification steps, the quantity of energy deriving from the condensation of methanol at the outlet from the first and/or the second reactor may be used to pre-heat the ester phase. This pre-heating step is carried out upstream of the inlet to the second reactor, prior to introducing the methanol.

In a further implementation, for a two-step reaction process, the quantity of energy deriving from the condensation of methanol at the outlet from the first and/or the second reactor may be used to pre-heat the stream of methanol before it is mixed with the ester phase upstream of the inlet to the second reactor.

In accordance with another implementation, in a two-step reaction process, the quantity of energy derived from the condensation of methanol at the outlet from the first and/or the second reactor may be used to directly pre-heat the stream constituted by the mixture of the ester phase with methanol entering the second transesterification reactor.

The transesterification reaction step is carried out at a pressure of 2 to 7 MPa and at a temperature of 140° C. to 230° C., at an hourly space velocity, HSV (ratio between the hourly volume flow rate of oil to be treated and the volume of catalyst) in the range 0.5 to 1.5 $h^{-1}$.

The glycerine which is co-produced has a purity in the range 95% to 99.9%, preferably in the range 98% to 99.9%. Thus, it is known as high purity glycerine.

In prior art FIG. 1, the methanol stream is introduced via the line 1 and is mixed with the pre-treated stream of oil moving in line 2. The mixture moving in the line 3 is taken to the desired pressure in the range 2 to 7 MPa, for example 6 MPa, and is heated in the exchanger F1 to a temperature in the range 140° C. to 230° C. before being introduced into the first transesterification reactor R1 comprising at least one fixed bed of solid heterogeneous catalyst, at an hourly space velocity (HSV) in the range 1.5 to 0.5 $h^{-1}$. The effluent leaving the first reactor and moving in the line 4 comprises methyl esters, glycerol, partially converted triglycerides and methanol. This effluent is expanded at a pressure of approximately 0.25 MPa and re-heated in the exchanger F2 to evaporate the excess methanol. The methanol vapour is then separated in the drum C1. A portion of the methanol vapour (stream 5*a*) is condensed via a condenser A1 and recycled to a knockout drum (not shown in the flowchart). Another portion (stream 5*b*) is sent to a distillation column (not shown in the flowchart) which can carry out water/methanol separation and control the water content in the feeds for the reactors.

The liquid obtained moving in the line 6 is then cooled and decanted in a drum (not shown in the figure) to separate the upper phase which is rich in methyl esters, which may supply the second reaction section, not shown in the figure, and the lower phase which is rich in glycerine which has to be specifically treated.

Figure 2:
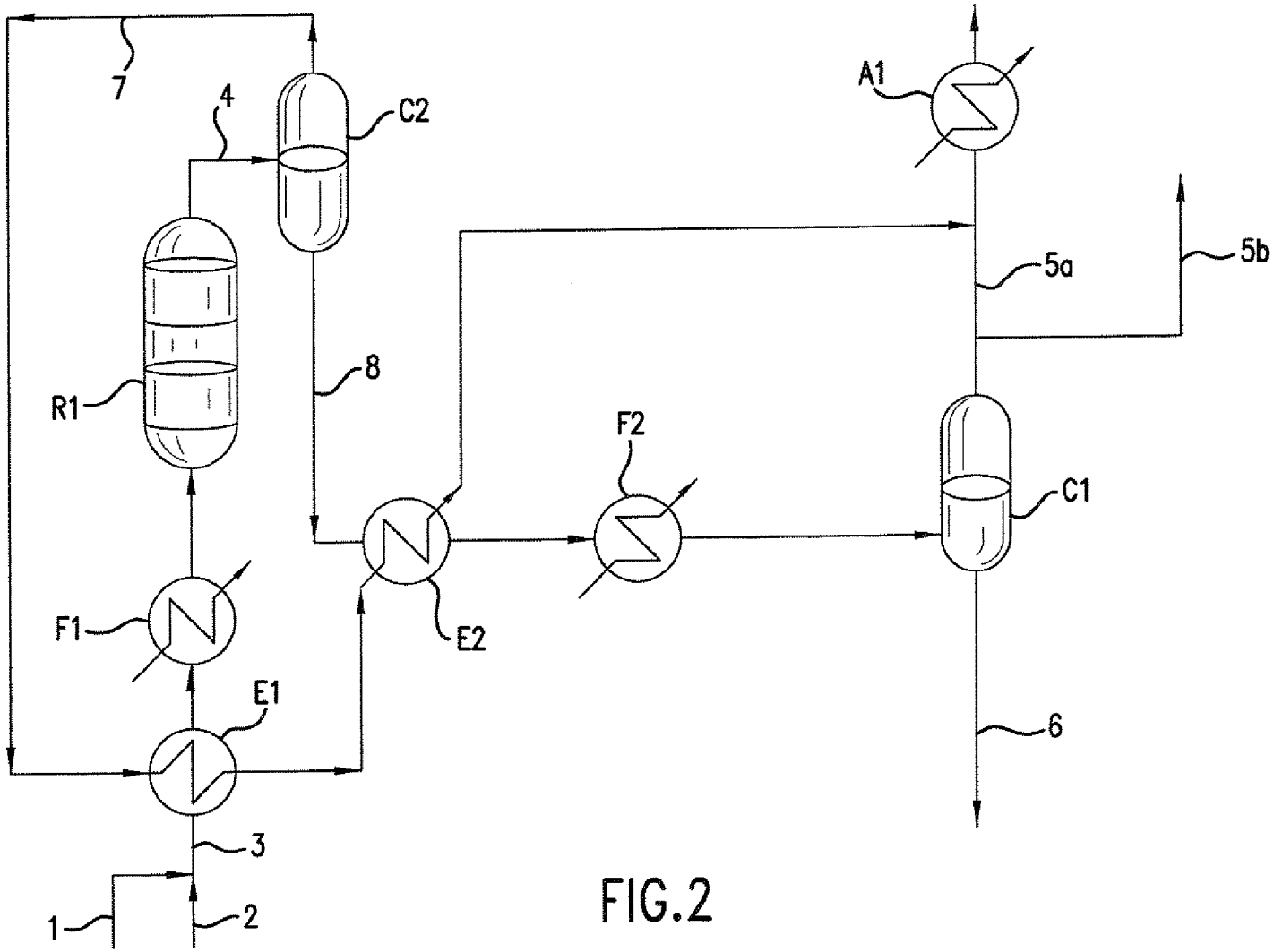
FIG. 2 is a diagrammatic representation of the process in accordance with an embodiment of the present invention comprising thermal integration, in which the energy is used to pre-heat oil before mixing it with the methanol.

FIG. 2, in accordance with the present invention, represents an implementation in which the quantity of energy recovered following expansion of the effluent from the transesterification reactor is used to pre-heat the oil/methanol mixture prior to introducing it into the first reactor. The stream of methanol is introduced via the line 1 and is mixed with the stream of pre-treated oil moving in the line 2. The mixture moving in the line 3 is taken to the desired pressure between 2 and 7 MPa, for example 6 MPa, and is heated to a temperature in the range 140° C. to 230° C. in exchanger E1 and F1 before being introduced into the first transesterification reactor R1 comprising at least one fixed bed of solid heterogeneous catalyst at an hourly space velocity (HSV) in the range 1.5 to 0.5 $h^{-1}$. The effluent leaving the first reactor and moving in the line 4 comprises methyl esters, glycerol, partially converted triglycerides and methanol.

This effluent is expanded at a pressure of more than 0.5 MPa, then the methanol vapour is separated in the drum C2, at a temperature of at least 111° C. This is the first expansion phase. The effluent moving in the line 7 constituted by methanol containing less than 1000 ppm of water is used to heat, in succession, the mixture of feeds constituted by oil and methanol prior to introducing them into the reactor R1 via the heat exchanger E1 then the liquid phase from drum C2 and moving in the line 8 via the exchanger E2. After passing through a condenser A1, the stream 7 is sent directly to the recycle knockout drum. The liquid fraction obtained after the first condensation step moving in the line 8 and which contains the remaining non-evaporated methanol, methyl esters, glycerine, as well as the partially converted triglycerides, is expanded to a lower pressure, of the order of 0.25 MPa, once re-heated via the exchangers E2 and F2. A portion of the remaining methanol is then evaporated in the drum C1. At the outlet from this drum, a portion of the stream of methanol vapour is sent to the condenser A1 (stream 5*a*) then is evacuated to a recycle knockout drum in the same manner as the stream 7. The stream 5*b*, constituted by a mixture of water and methanol vapour, is sent to a distillation column.

In another implementation of the process, not shown in the figure, all of the stream of methanol leaving the drum C1 is sent to the condenser A1. At the outlet from this condenser, a portion of the stream of liquid methanol is evacuated to a recycle knockout drum (stream 5*a*) in the same manner as the stream 7. The stream 5*b*, constituted by a mixture of water and liquid methanol, is sent to a distillation column via a pump, not shown in the figure.

In the same manner as for FIG. 1, the liquid obtained moving in the line 6 is then cooled and decanted in a decanter drum (not shown in the figure) to separate the upper phase which is rich in methyl esters, which may optionally be supplied to the second reaction section, and a lower phase which is rich in glycerine, which has to be treated specifically.

Advantageously, when the process is carried out in two successive reaction steps, the various streams sent to the distillation column originating from the vapour effluents from the second expansion phase at the outlet from the first and second reactors may be sent to various levels in the distillation column, as a function of their respective water contents.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding FR application Ser. No. 10/04.122, filed 21 Oct. 2010, are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for the production of methyl esters of fatty acids and high purity glycerine, employing at least one transesterification reaction between a vegetable or animal oil and methanol, in the presence of a solid heterogeneous catalyst, comprising in succession:

at least one transesterification step during which the vegetable or animal oil is mixed with an excess of methanol in a reactor containing a fixed bed of catalyst;

at least one step for expansion of the effluent from the reactor, followed by a step for separation, at the end of which a phase which is rich in methanol and a phase which is depleted in methanol are obtained;

at least one step for concentration of the methanol contained in the rich phase;

at least one step for decanting the methanol-depleted phase to separate the glycerine from the upper phase which is rich in methyl esters;

said process being characterized in that said step for expansion and separation of methanol is staged and is carried out in at least two phases:

a) a first phase for expansion of the effluent obtained at the reactor outlet, carried out at a pressure of at least 0.5 MPa, in order to obtain a first fraction of methanol vapour and a liquid fraction containing non-evaporated methanol, methyl esters, glycerol and partially converted triglycerides, said first phase for expansion and separation being followed by a step for condensation of said methanol vapour fraction into a fraction of methanol which is liquid at a temperature of at least 111° C., releasing a quantity of energy Q, the liquid methanol fraction obtained being sent directly to a recycle knockout drum, said quantity Q being used to heat at least one of the process streams;

b) a second phase for expansion, at a pressure which is lower than that of step a) of the liquid fraction containing non-evaporated methanol, methyl esters, glycerol and partially converted triglycerides, in order to obtain a second fraction of methanol vapour, at least a portion of said second fraction being sent to the recycle knockout drum after having undergone a condensation step, the other portion of said second fraction being sent to the methanol concentration step.

2. A process according to claim 1, in which the first fraction of methanol vapour obtained after the first expansion phase contains less than 1000 ppm of water.

3. A process according to claim 1, in which said second fraction obtained in step b) and sent to the methanol concentration step undergoes a step for condensation at the end of which a liquid fraction comprising a mixture of methanol and water is obtained, prior to being sent to the methanol concentration step.

4. A process according to claim 3, in which the two condensation steps carried out in step b), respectively of the fraction to be sent to the recycle knockout drum and the fraction to be sent to the methanol concentration step, may be carried out together or separately.

5. A process according to claim 4, in which the condensation steps carried out on the two portions of the second fraction are carried out together, the whole of the methanol vapour fraction obtained after the second expansion phase of step b) undergoing a condensation step before being separated into two fractions, one being sent to the recycle knockout drum and the other to the methanol concentration step.

6. A process according to claim 1, in which said quantity of energy corresponding to the enthalpy of condensation from the vapour state to the liquid state following the first phase for expansion of the effluent from the transesterification reactor is used to pre-heat the stream of oil prior to mixing with the methanol before entering the first transesterification reactor.

7. A process according to claim 1, in which said quantity of energy Q is used to pre-heat the recycled methanol stream before it is mixed with the oil pre-treated upstream of the transesterification reactor inlet.

8. A process according to claim 1, in which said quantity of energy Q is used to heat the stream constituted by a mixture of oil and methanol entering the transesterification reactor.

9. A process according to claim 1, in which two reaction steps in succession are carried out, the phase which is rich in methyl esters obtained after the decanting step being mixed with methanol before being sent to a second transesterification reactor.

10. A process according to claim 9, in which the quantity of energy from the condensation of methanol at the outlet from the first and/or the second reactor is used to pre-heat one of the effluents entering the first and/or the second reactor.

11. A process according to claim 9, in which said quantity of energy from the condensation of methanol at the outlet from the first and/or the second reactor is used to pre-heat the stream of methanol before it is mixed with the ester phase upstream of the inlet to the second reactor.

12. A process according to claim 9, in which the quantity of energy from the condensation of methanol at the outlet from the first and/or the second reactor is used to pre-heat the ester phase upstream of the inlet to the second reactor prior to the introduction of methanol.

13. A process according to claim 9, in which said quantity of energy from the condensation of methanol at the outlet from the first and/or the second reactor is used to directly pre-heat the stream constituted by the mixture of the ester phase and methanol entering the second transesterification reactor.

14. A process according to claim 1, in which the transesterification reaction takes place at a temperature in the range 140° C. to 230° C., a pressure in the range 2 to 7 MPa and an hourly space velocity in the range 0.5 to 1.5 $h^{-1}$.

* * * * *